United States Patent [19]

Göller

[11] Patent Number: 4,674,203

[45] Date of Patent: Jun. 23, 1987

[54] INNER PART OF SHOE WITH A SURFACE MASSAGING THE SOLES OF THE FEET AND PROCESS FOR ITS FABRICATION

[76] Inventor: Gerd Göller, Beckenhofer Strasse 25, D-6780 Pirmasens/Pfalz, Fed. Rep. of Germany

[21] Appl. No.: 830,569

[22] Filed: Feb. 18, 1986

[30] Foreign Application Priority Data

Mar. 6, 1985 [DE] Fed. Rep. of Germany ... 8506415[U]

[51] Int. Cl.[4] ..... A43B 13/38; A43B 7/08

[52] U.S. Cl. ..... 36/44; 36/3 B; 128/582; 12/146 B

[58] Field of Search ..... 36/43, 44, 11.5, 3 B, 36/25 R; 128/582, 25 B; 12/146 R, 146 B, 146 BR

[56] References Cited

U.S. PATENT DOCUMENTS

| | | | |
|---|---|---|---|
| 2,820,454 | 1/1958 | Wright | 128/25 B |
| 4,173,216 | 11/1979 | Nolet | 128/25 B |
| 4,215,492 | 8/1980 | Sandmeier | 36/44 |
| 4,224,746 | 9/1980 | King | 36/3 B |
| 4,329,981 | 5/1982 | Dungl | 128/25 B |
| 4,509,510 | 4/1985 | Hook | 36/44 X |

FOREIGN PATENT DOCUMENTS

| | | | |
|---|---|---|---|
| 0100067 | 2/1984 | European Pat. Off. | 36/43 |
| 2024534 | 12/1971 | Fed. Rep. of Germany . | |
| 8304272 | 10/1983 | Fed. Rep. of Germany | 36/43 |
| 8415720 | 9/1984 | Fed. Rep. of Germany | 36/43 |
| 3308731 | 9/1984 | Fed. Rep. of Germany | 36/25 R |
| 3344536 | 6/1985 | Fed. Rep. of Germany | 36/43 |

*Primary Examiner*—James Kee Chi

*Attorney, Agent, or Firm*—Toren, McGeady & Associates

[57] ABSTRACT

An inner or inner sole for a shoe in the shape of an insert sole or of a foot support consists of a substructure from a compact or cellular structure shaped, elastic material. On the upper side a plurality of lugs arranged in rows for massaging the soles of the feet is provided. These rows of lugs interpenetrate or cross at an angle of approximately 120° and exhibit an angle of approximately 60° to the longitudinal axis of the sole. A covering 2 of soft leather is glued onto the rounded heads of the lugs. By means of a plurality of perforations 4 of small diameter a continuous air exchange is possible.

4 Claims, 2 Drawing Figures

INNER PART OF SHOE WITH A SURFACE MASSAGING THE SOLES OF THE FEET AND PROCESS FOR ITS FABRICATION

BACKGROUND OF THE INVENTION

The invention is directed to the inner part of a shoe in the form of an insert sole or innersole as a foot support, with a substructure formed from compact or cellular structure-shaped elastic material, and a plurality of knobs arranged in rows which massage the soles of the feet, which have an approximately cylindrical base and a round head, and a covering above the knobs from fabric, smooth leather or such like. Furthermore, it the invention concerns a process for fabrication of the insertable innersole.

Shoes and sandals with foot support are generally known. They are worn by people whose feet are subjected to a lot of strain, for instance in exercising their profession, or which are already changed.

In order to achieve a better blood circulation through the feet, so-called massage-sandals are also known, for instance from the U.S. Pat. No. 4,095,353 or U.S. Pat. No. 3,722,113. These have a surface formed of a plurality of plastics lugs with rounded off top sides. In these, to be sure, the massage effect and also the aeration of the soles of the feet is good; it has, however, been shown the the elasticity of these lugs is too small, in order to adequately unload or relieve hip joints, knee joints etc. Also there is no possibility to subsequently equip shoes with such a plate with lugs.

A shoe design is known from the European patent application EP No. 100 067-A, in which the inner sole is supported by the walking sole. The upper surface of the inner sole is adapted to the anatomical shape of the foot. It carries a series of elevations with rounded heads. A covering from fabric or leather is stretched over the inner sole and is glued with the back side of the inner sole. The elevations are arranged in rows parallel to the longitudinal axis of the inner sole.

This type of construction of a shoe has several disadvantages. The covering has to be cut out with a wide margin. The increased expenditure of material makes the shoe more expensive. The gluing of the covering on the rear side of the inner sole requires additional work processes. When walking the covering rubs on the elevations of the inner sole and is thus destroyed. Apart from that creases can arise in the loose covering during the walking process, which cause blisters on the feet. Apart from that the aeration of the sole of the foot is impaired by the loose covering.

SUMMARY OF THE INVENTION

Contrary to this the present invention is based on the task to provide the inner part of a shoe, which combines a good massage effect on the soles of the feet and elasticity for unloading of the joints along with an improved aeration of the soles of the feet, an improved comfort and a smaller expenditure of material, and an inner part which can be used in the shoe in a fixed as well as a loose manner.

This task is solved in that the covering is cut without oversize, that the covering is glued onto the tips of the lugs, whereby its top side is undulated, and that the covering is perforated at least in the area of the ball of the foot and of the heel.

Preferably the lugs are arranged in rows, which cross at an angle of approximately 120° and in particular assume an angle of approximately 60° to the longitudinal axis of the shoe inner part or inner sole. This arrangement is much more comfortable when running than the parallel arrangement of the known shoe design. Apart from that it affords considerable advantages during fabrication.

The inventive process for fabrication of the inner part of the shoe is characterized in that the lugs are coated in the areas of their tips with glue in a squeezing device and that subsequently the covering is applied and also pressed on. Thereby rotating rollers are preferably used as a pressing device.

By coating the lugs, which consist of elastic material, in a pressing device one achieves that the rounded off tips of the lugs are completely coated with glue, so that a gluing connection with a large area results with respect to the covering.

By the pressing of the covering in an additional pressing device, the covering itself is somewhat pressed downwards into the intermediate areas between the lugs. Thereby air-carrying depressions are created in direct vicinity to the sole of the foot. By perforations in the covering itself an air-carrying connection to the cavities beneath the covering is produced, whereby an uninterrupted, air exchange over a large area is achieved.

By the lug-shaped surface a massage-like effect is produced upon the sole of the foot by the roll-off action when walking, whereby improved blood circulation in the feet and the legs is achieved. Simultaneously, the air aspirated through the perforations in the covering is pumped throughout the entire sole through the air channel system formed between the lugs and the covering. This should find particular application in case of blood circulation disorders in connection with cold feet. A special shock absorber effect upon the hip joint and the entire spine is achieved by means of the upholstered lug shape of the support of the sole of the foot.

Foot supports equipped in this manner should particularly find use during changes of the spine, for instance in intervertebral disk damage and other degenerative changes for instance of the hip joints.

Since the possibility exists to change the lugs, a preferred application in case of foot changes, as for instance, concave feet, knock-splay feet or feet with fallen arches etc., as well as in the case of Achilles tendon irritations or patella syndromes, is also possible.

Furthermore, it is possible to make the joint- and heel portion of the inventive inner part of the shoe separately, or to equip it with appropriate inserts.

BRIEF DESCRIPTION OF THE DRAWINGS

The invention will be described with particularity with the help of the drawing in the form of an embodiment example.

In the drawing.

DETAILED DESCRIPTION OF THE INVENTION

Figure 1:
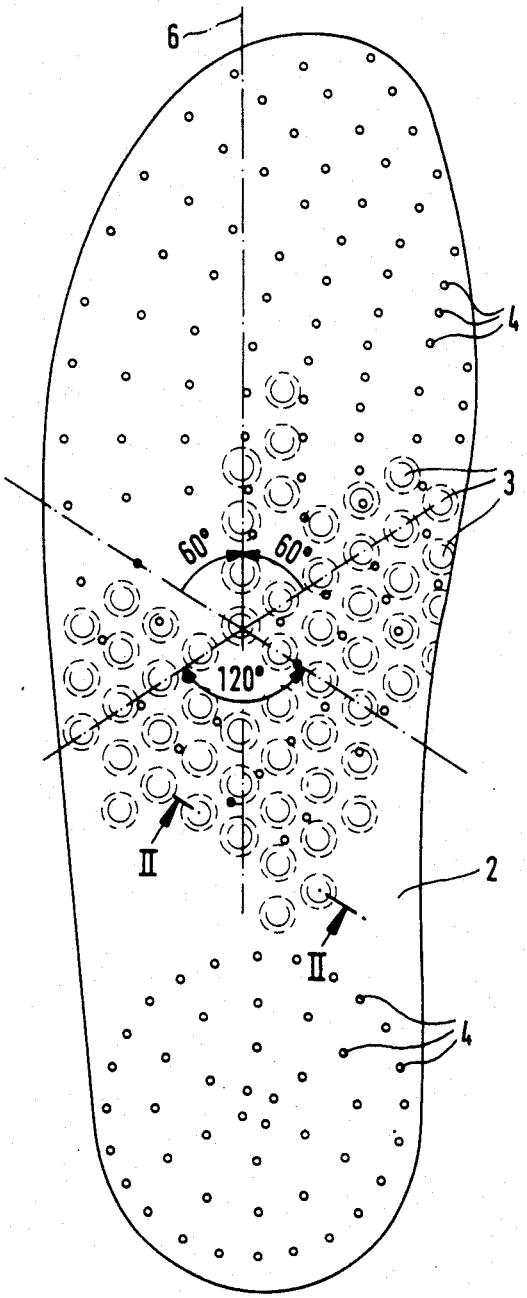
FIG. 1 is a plan view of the insert sole or inner sole.
Figure 2:
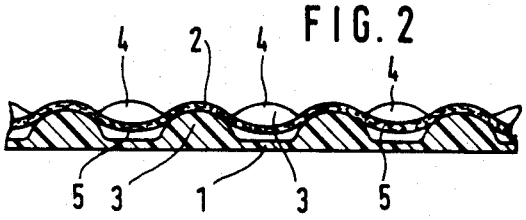
FIG. 2 is a section II—II through the sole in FIG. 1.

The insert or inner sole consists of a substructure 1, on whose upper side a plurality of lugs 3 are molded on in uniform rows. The lugs 3 have an approximately cylindrical base and a rounded head. A covering 2 of a smooth leather is glued upon the heads of the lugs 3.

The covering 2 is equipped in the heel and ball area with a plurality of perforations 4 of small diameter. Thereby an air exchange through the covering 2 is possible.

The lugs 3 are arranged in rows, which interpenetrate or cross at an angle of approximately 120° and in particular assume an angle of approximately 60° to the longitudinal axis of the inner sole. This arrangement provides a higher comfort than other arrangements in the course of the rolling action of the foot when walking. Apart from that there results the desired undulated shape of the covering 2 in the simplest manner by laminating the covering 2 upon the substructure 1 with the help of pressure rollers.

This waveform leads to a row of air-filled depressions remaining above the covering 2, meaning in direct vicinity to the foot.

Simultaneously continuous air channels 5 remain open also beneath the covering 2. The air absorbing the sweat of the foot is thus pumped into the channel system 5 beneath the covering through the perforations 4, to be mixed there with an air supply, then pumped through the channel system 5 and finally is brought again to the sole of the foot through the perforations 4. Thereby not only a diminution of foot sweat generation is achieved, but also an additional air cushion effect, which assists the cushioning effect of the elastic material, of which the substructure 1 and the lugs 3 consist.

I claim:

1. Inner part for a shoe in the shape of an insert sole or innersole, comprising a substructure formed of a compact sole-shaped elastic material structure, said substructure having an upwardly facing surface and a downwardly facing surface and having a longitudinal axis extending in the toe-heel direction of said substructure, a plurality of lugs arranged in rows on the substructure for massaging the sole of a foot, said lugs having an approximately cylindrical base extending upwardly from said substructure and a rounded head on the upper ends of said lugs, and a soft material covering located above the lugs, wherein the improvement comprises that the covering (2) is cut without oversize to the sole shape of said substructure, said lugs (3) are spaced apart from adjacent said lugs, the covering (2) is glued to the heads of the lugs (3), whereby the covering (2) is undulated having a waveform with crests over the lugs and depressions between the lugs, said covering (2) in the region of the depressions being spaced upwardly from the upwardly facing surface of said substructure and forming, in combination with the substructure and lugs, air channels (5) between the covering and the substructure and between adjacent said lugs, said covering (2) is perforated at least in the ball and heel area of the foot, said lugs (3) are arranged in rows extending generally transversely of the longitudinal axis with said rows crossing at an angle of approximately 120°, and the rows of the lugs (3) are arranged at an angle of approximately 60° to the longitudinal axis of said substructure.

2. Inner part, as set forth in claim 1, wherein the downwardly facing surface of said substructure is planar.

3. Process of fabricating an inner part for a shoe in the shape of an insert sole or innersole comprising the steps of providing a sole-shaped elastic material substructure with rows of lugs in spaced relation thereon and extending upwardly from the substructure, shaping the lugs with rounded heads spaced upwardly from the substructure, applying glue to the head of the lugs, and pressing a soft covering material downwardly against the heads of the lugs forming a covering over the substructure with the covering having a waveform configuration with crests over the lugs and depressions between the lugs so that air channels are formed between the covering material and the substructure and between adjacent lugs.

4. Process, as set forth in claim 3, wherein pressing the soft covering material against the lugs by using rotating rollers.

* * * * *